US009958212B2

(12) United States Patent
Lv et al.

(10) Patent No.: US 9,958,212 B2
(45) Date of Patent: May 1, 2018

(54) SUPERPOSED HEAT EXCHANGER

(71) Applicants: HAIER GROUP CORPORATION, Shandong (CN); QINGDAO HAIER DRUM WASHING MACHINE CO., LTD., Shandong (CN)

(72) Inventors: Peishi Lv, Shandong (CN); Yonghong Xu, Shandong (CN); Xueli Zhao, Shandong (CN); Huacheng Zhang, Shandong (CN); Yuliang Jiang, Shandong (CN)

(73) Assignees: Haier Group Corporation, Shandong (CN); Quingdao Haier Drum Washing Machine Co., Ltd., Shandong (CN)

( * ) Notice: Subject to any disclaimer, the term of this patent is extended or adjusted under 35 U.S.C. 154(b) by 2 days.

(21) Appl. No.: 15/125,544

(22) PCT Filed: Jun. 10, 2014

(86) PCT No.: PCT/CN2014/079581

§ 371 (c)(1),
(2) Date: Sep. 12, 2016

(87) PCT Pub. No.: WO2015/135262

PCT Pub. Date: Sep. 17, 2015

(65) Prior Publication Data

US 2017/0010047 A1 Jan. 12, 2017

(30) Foreign Application Priority Data

Mar. 14, 2014 (CN) ..... 2014 1 0096227

(51) Int. Cl.
*F28D 7/02* (2006.01)
*F28D 9/00* (2006.01)
(Continued)

(52) U.S. Cl.
CPC ..... *F28D 9/0037* (2013.01); *D06F 58/24* (2013.01); *F28D 9/02* (2013.01); *F28F 3/08* (2013.01);
(Continued)

(58) Field of Classification Search
CPC .. F28D 9/0037; F28D 9/02; F28D 2021/0038; F28D 1/0535; F28F 3/08;
(Continued)

(56) References Cited

U.S. PATENT DOCUMENTS 5,816,320 A * 10/1998 Arnold ..... F28D 1/0535 165/152
5,901,167 A * 5/1999 Sukhman ..... H01S 3/041 372/34
(Continued)

FOREIGN PATENT DOCUMENTS

CN 101405559 A 4/2009
CN 101421580 A 4/2009
(Continued)

OTHER PUBLICATIONS

International Search Report dated Dec. 10, 2014 from International Patent Application No. PCT/CN2014/079581 filed Jun. 10, 2014.
European Search Report dated Oct. 27, 2017 from European Patent Application No. 14885480.5 filed Jun. 10, 2014.

*Primary Examiner* — Davis Hwu
(74) *Attorney, Agent, or Firm* — Sunstone IP

(57) ABSTRACT

Disclosed is a superposed heat exchanger, including a plurality of fins superposed up. Two opposite side edges of each fin are bent upwards to form a ventilating air path in coordination with an upper fin, and adjacent fins are arranged in a mode of vertical-horizontal alternating so as to form horizontal air paths and vertical air paths independent from each other with up-down intervals.

16 Claims, 12 Drawing Sheets

(51) Int. Cl.

| | |
|---|---|
| ***F28F 3/08*** | (2006.01) |
| ***F28D 9/02*** | (2006.01) |
| ***D06F 58/24*** | (2006.01) |
| ***F28F 9/00*** | (2006.01) |
| ***F28F 19/01*** | (2006.01) |
| ***F28G 9/00*** | (2006.01) |
| *F28D 21/00* | (2006.01) |

(52) U.S. Cl.
CPC ..... *F28F 9/001* (2013.01); *F28F 19/01* (2013.01); *F28G 9/00* (2013.01); *F28D 2021/0038* (2013.01); *F28F 2250/106* (2013.01); *F28F 2275/085* (2013.01); *F28F 2275/14* (2013.01)

(58) Field of Classification Search
CPC ..... F28F 9/001; F28F 19/01; F28F 2250/106; F28F 1/32; D06F 58/24
USPC ..... 165/165
See application file for complete search history.

(56) References Cited

U.S. PATENT DOCUMENTS

| | | | | |
|---|---|---|---|---|
| 2003/0178176 | A1* | 9/2003 | Jenkins ..... | F28F 1/32 165/61 |
| 2012/0256330 | A1 | 10/2012 | Lee et al. | |

FOREIGN PATENT DOCUMENTS

| | | | |
|---|---|---|---|
| CN | 202361866 | U | 8/2012 |
| JP | H07234087 | A | 9/1995 |
| JP | H0842988 | A | 2/1996 |
| JP | 2002372391 | A | 12/2002 |
| JP | 2005140362 | A | 6/2005 |
| JP | 2007255754 | A | 10/2007 |
| WO | 2013/067837 | A1 | 5/2013 |
| WO | 2013/0157056 | A1 | 10/2013 |

* cited by examiner

SUPERPOSED HEAT EXCHANGER

CROSS REFERENCE TO RELATED APPLICATION(S)

This application is a U.S. National Stage Entry of International Patent Application No. PCT/CN2014/079581, filed Jun. 10, 2014, which claims the benefit of Chinese Patent Application No. 201410096227.0, filed on Mar. 14, 2014, the disclosures of which are hereby incorporated entirely herein by reference.

TECHNICAL FIELD

The present disclosure relates to the field of clothes drying, and particularly relates to a superposed heat exchanger for condensing vapors in a clothes dryer or a washer dryer.

TECHNICAL BACKGROUND

With the continuous upgrading and optimization of energy efficiency standards in the household electrical appliance industry, more and more users begin to turn their attention to energy efficiency parameters of products; therefore, energy conservation and environment protection have become a direction of industrial development.

Therefore, the washer-dryer that integrates washing, dehydrating and drying has its drying capacity increased along with the upgrading of the industry. During drying, a drum-type washer-dryer shall be capable of both evaporating water in clothes into vapors and condensing the evaporated vapors into water by using its energy.

At present, there are three forms of condensation in the industry: the first method is to condense vapors by using cold tap water. The advantages of this method are low manufacturing cost and simple application, and the disadvantage is that water shall be fed into the machine continuously during operation for cooling, which will consume a large amount of water. The second method is to condense vapors by using refrigerating fluids in the compressor based on a compressor principle. The advantages of this method are low energy efficiency and low water and power consumption, and the disadvantages are high cost, expensive price and badness for popularization. The third method is to condense vapors with outside air by using an air heat exchanger; it saves water and power and has low equipment cost, despite of its lower condensation efficiency than the compressor.

In the existing art, heat exchangers are made of aluminum alloy materials and manufactured in two ways: one way is the flat design of aluminum alloys, which is convenient for vapor to pass; the other way is the curved aluminum plate design which is easy for heat dissipation. Generally, due to the space limitation of a washing machine, two heat dissipation routes shall be provided to the maximum. As the aluminum alloy materials need high manufacturing cost, the effect of heat dissipation is limited by the manufacturing process of aluminum alloy foils and the contact area between the vapor and a condenser is small, thereby being not beneficial to vapor condensation.

In view of this, the present disclosure is proposed.

SUMMARY

The purpose of the present disclosure is to overcome disadvantages of the existing art and provide a superposed heat exchanger, which can increase the area of heat dissipation, increase the heat exchange efficiency and is simple and accurate for positioning.

To achieve the purpose, the following technical solution is adopted in the present disclosure: a superposed heat exchanger including a plurality of fins superposed up; two opposite side edges of each fin are bent upwards to form a ventilating air path in coordination with an upper fin, and adjacent fins are arranged in a mode of vertical-horizontal alternating so as to form horizontal air paths and vertical air paths independent from each other.

Downward convex pins are arranged on lower surfaces of two upwards bent side edges of the fin, and downward concave slots are arranged in upper surfaces of other two side edges; and pins of the fins are inserted into slots on lower fins so as to connect an upper and a lower adjacent fins.

A plurality of downward profiled grooves are provided in parallel on the fin in a direction vertical to the air path formed by the fin and an upper fin, and an air path formed with a lower fin is divided into a plurality of parallel air paths by the profiled grooves.

Downward profiled grooves are provided on the fin in an air inlet and an air outlet in the front and rear of air paths formed between the fin and an upper fin, and the profiled grooves form the slots.

A profiled depth on both ends of the profiled groove is larger than a profiled depth in middle of the profiled groove, so that a downward convex is formed so as to form the pin.

Four side edges of the fin are bent outwards to form turn-ups; turn-ups of adjoining upper and lower fins are overlapped; and turn-ups at the slots are overlapped and fitted closely on turn-ups, which are bent upwards first before bent outwards, on a lower fin.

A plurality of upward profiled grooves are provided in parallel on the fin in a direction parallel to the air path formed by the fin and an upper fin, and an air path formed with an upper fin is divided into a plurality of parallel air paths by the profiled grooves.

Materials of the fins is plastics.

Thickness of the fins is 0.2-0.5 mm, or 0.3 mm.

A frame is arranged outside the heat exchanger, and frame plates are arranged on an upper side, a lower side, a left side, a right side, a front side and a back side of the heat exchanger; and the frame is of an enclosure structure formed by connecting the frame plates arranged on the sides of the heat exchanger.

Through holes matched with an air path of an internal heat exchanger are formed in two groups of frame plates opposite to air paths of the heat exchanger on the frame, and another group of opposite frame plate is a flat plate; the through holes may be rectangular through holes arranged horizontally and vertically; and the through holes formed in two groups of opposite frame plates correspond to an inlet and an outlet of a horizontal air path and a vertical air path respectively.

A connecting part is arranged on a connector of each frame plate on the frame, and adjacent frame plates are connected through connecting parts; each connecting part may be of a buckle structure; two groups of frame plates with the through holes are provided with a plurality of parallel grooves on internal surfaces, and the grooves of the internal surfaces of the frame plates correspond to closely fitted turn-ups; the closely fitted turn-ups are inserted into grooves of internal surfaces of corresponding frame plates; a plurality of sheet-shaped bulges vertical to frame plates are arranged on adjacent edges of the two groups of frame plates with the through holes; a shape of the sheet-shaped bulges is identical with that of a space between corresponding adjacent turn-ups at the pins; and the sheet-shaped bulges are respectively inserted into the space between corresponding adjacent turn-ups at the pins.

The vertical air path is arranged vertically to correspond to a hot air inlet and a hot air outlet; the horizontal air path is arranged horizontally to correspond to a cold air inlet and a cold air outlet; an upper cover plate is arranged at the hot air inlet; the upper cover plate has a slanting top surface; the upper cover plate forms a chamber with the heat exchanger; the air inlet of an air condensing structure is formed on the chamber at one end where the upper cover plate is inclined highly and away from the heat exchanger; a lower cover plate is arranged at the hot air outlet of the heat exchanger; one side of the lower cover plate is an air outlet of the air condensing structure; and the upper and the lower cover plates are connected with flat frame plates.

A filter is arranged between the air inlet and the hot air inlet of the heat exchanger; the filter is arranged between the air inlet of the air condensing structure and the hot air inlet of the heat exchanger in a pushable-pullable mode; the filter may be arranged in the chamber. The filter is in sliding connection with side walls of the chamber, and one end of the filter protrudes out of the chamber; when one end of the filter is located in the innermost place of the chamber, the other end of the filter is located outside the chamber and is tightly sealed with an opening of the chamber through which the filter penetrates; sliding chutes/sliding blocks may be arranged on two side edges of the filter, and sliding blocks/sliding chutes are arranged on corresponding side walls of the chamber; and the sliding chutes/sliding blocks are matched with the sliding blocks/sliding chutes so as to form sliding connection.

A flushing structure is arranged between the air inlet and the hot air inlet of the heat exchanger. The flushing structure may include a spray layer and a seal cover which form a cavity; a plurality of spray holes are formed in the spray layer; water inlets are formed in the seal cover; the spray layer serves as the upper cover plate arranged at the hot air inlet of the heat exchanger; the seal cover is arranged on an upper part of the upper cover plate and is in sealed connection with the upper cover plate; and a plurality of spray holes are formed in the upper cover plate.

An air intake uniform structure is arranged between the air inlet and the hot air inlet of the heat exchanger; a plurality of vertical ribbed slabs may be arranged in the air inlet and on an inner surface of top of the upper cover plate so as to divide the air inlet into a plurality of uniform air paths, so that the air intake uniform structure is formed; an air outtake uniform structure is arranged between the air outlet of the air condensing structure and the hot air outlet of the heat exchanger; a lower cover plate may be arranged at a condensed hot air outlet of the heat exchanger; a plurality of air outlets are formed on one side of the lower cover plate; and the plurality of air outlets in a shape of Chinese character "众" are communicated to a general air outlet, so that the air outtake uniform structure is formed.

The heat exchanger is arranged on a lower part of a clothes dryer or a washer dryer, with the air inlet located in an upper part and the air outlet located in a lower part; the air inlet and air outlet are communicated with a drum through an air duct respectively; either the air inlet or the air outlet is provided with a fan, and the other one is opened to atmosphere.

After the technical solution of the present the disclosure is adopted, the following beneficial effects are brought:

1. The heat exchanger of the present disclosure uses plastic fins which are characterized by simple molding, controllable thickness and very thin shape; the number of the fins can be increased within an effective space so as to increase the heat dissipation area and increase the heat exchange efficiency; the profiled grooves can not only play the role of positioning, but also can form the air path to guide the air flow; meanwhile, the strength of the fins can be increased to prevent deformation and to increase the contact area for heat dissipation and the efficiency for heat exchange; the pins, the slots and the bent turn-ups are located and connected and are superposed directly in a mode of vertical-horizontal alternating without using other connecting components; and the positioning is simple and accurate.

2. In the present disclosure, a frame is arranged outside the heat exchanger, thereby not only fixing the heat exchanger, but also enhancing the strength of the heat exchanger, improving the operating reliability of the heat exchanger, prolonging the service life, reducing the failure repair rate of a machine, and reducing the maintenance cost of the machine; the frame and each fin are positioned and connected, assembled mutually, supported mutually, and connected firmly; the structure is simple and the installation is convenient.

3. In the present disclosure, a filtering structure is arranged for filtering lint produced during clothes drying to avoid blocking the air path of the heat exchanger, and the filtering structure can be in drawer-type sliding connection to draw out the filtering structure for cleaning, which facilitates operation.

4. In the present disclosure, a flushing structure is arranged to flush lint automatically in the filtering structure or in the air path of heat exchanger so as to avoid the increase of an air drag coefficient of a system due to the lint, thereby prolonging the service life of the heat exchanger; and the water flow is adopted for flushing instead of manual cleaning, thereby enhancing the automation level of the machine.

5. In the present disclosure, an air uniform structure is arranged so that air flows in the air inlet and the air outlet can be uniformly transited and uniformly distributed to all air paths of the heat exchanger for condensing; thus, on one hand, the unevenness of hot air is avoided and the heat exchange efficiency is increased, and on the other hand, an effect on the system caused by uneven pressure due to uneven air flows is avoided.

Specific embodiments of the present disclosure are further detailed in combination with drawings.

REFERENCE NUMBERS

1. Fin 11. First Fin 12. Second Fin 4. Pin 5. Slot 6. Profiled Groove 7. Turn-up 8. Frame Plate 9. Through Hole 13. Notch 14. Clamping Column 15. Clamping Bulge 16. Hole 17. Clamping Tongue 18. Clamping Port 19. Buckle 20. Clamping Groove 21. Groove 22. Sheet-Shaped Bulge 23. Seal Baffle Plate 24. Hot Air Inlet 25. Upper Cover Plate 26. Filtering Structure 27. Air Duct 28. Chamber 29. Front Panel 30. Drum 31. Hot Air Path 32. Cold Air Path 33. Inlet Port 34. Fan 35. Heat Exchanger 36. Air Inlet 37. Air Outlet 38. Ribbed Slab 39. Lower Cover Plate 40. Spray Layer 41. Seal Cover 42. Spray Hole 43. Water Inlet 44. Water Pump 45. Inlet Port 46. Side Plate.

DETAILED DESCRIPTION

Figure 1:
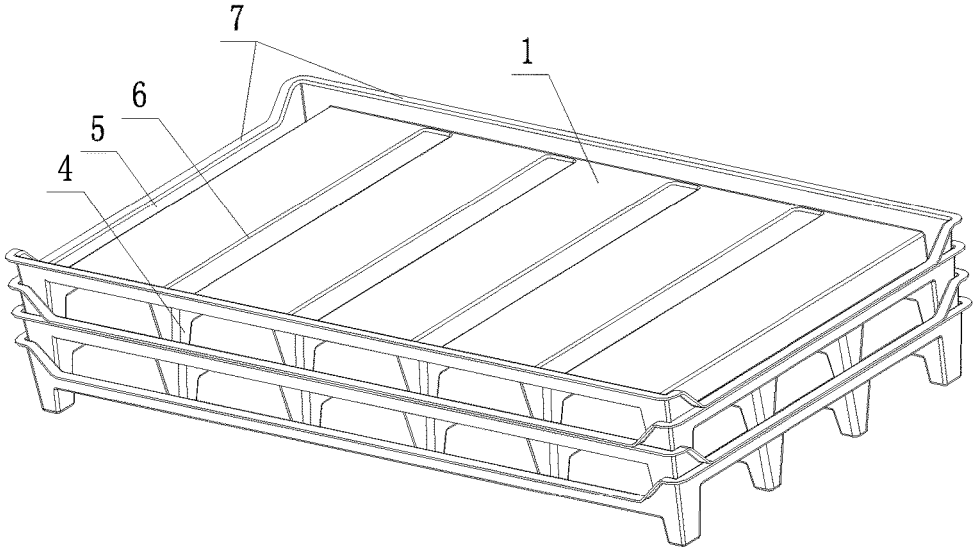
FIG. 1 is a structural diagram showing a heat exchanger in the present disclosure.
Figure 2:
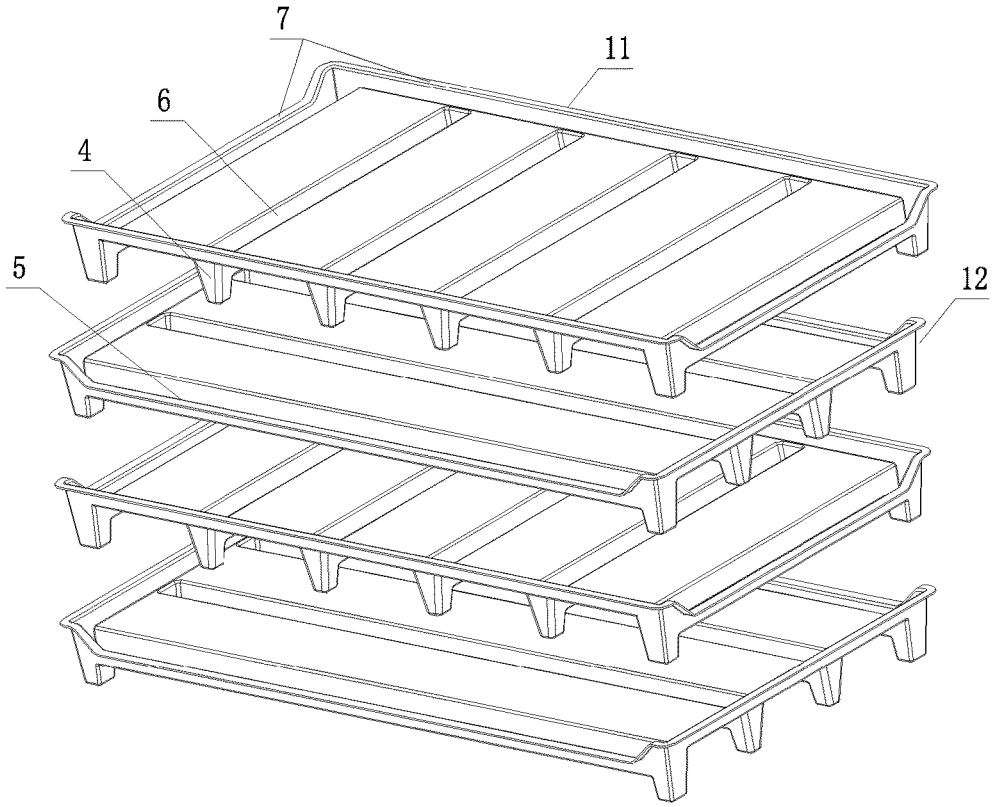
FIG. 2 is an exploded structural diagram showing a superposed heat exchanger in the present disclosure.

As shown in FIG. 1 and FIG. 2, the present disclosure describes a superposed heat exchanger including a plurality of fins 1 that are superposed up. Two opposite side edges of each fin 1 are bent upwards to form an air path in coordination with an upper fin 1. Adjacent fins 1 are arranged in a mode of vertical-horizontal alternating so as to form horizontal air paths and vertical air paths independent from each other at certain intervals, where high-temperature air flow can pass through the horizontal air path and low-temperature air flow can pass through the vertical air path, or conversely. Air flows with different temperatures contact indirectly inside to exchange heat. Fins are made of plastics and are characterized by simple molding, controllable thickness and very thin shape, and the number of fins can be increased within an effective space so as to increase the heat dissipation area and increase the heat exchange efficiency.

Figure 3:
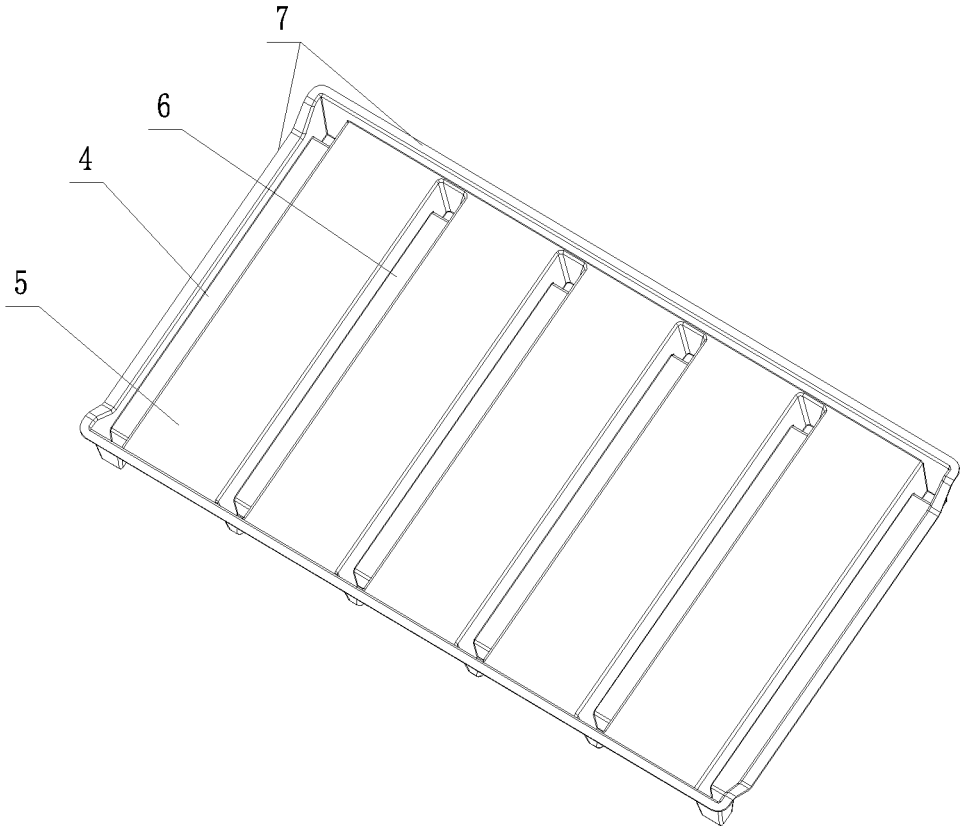
FIG. 3 is a structural diagram showing a first fin in the present disclosure.
Figure 4:
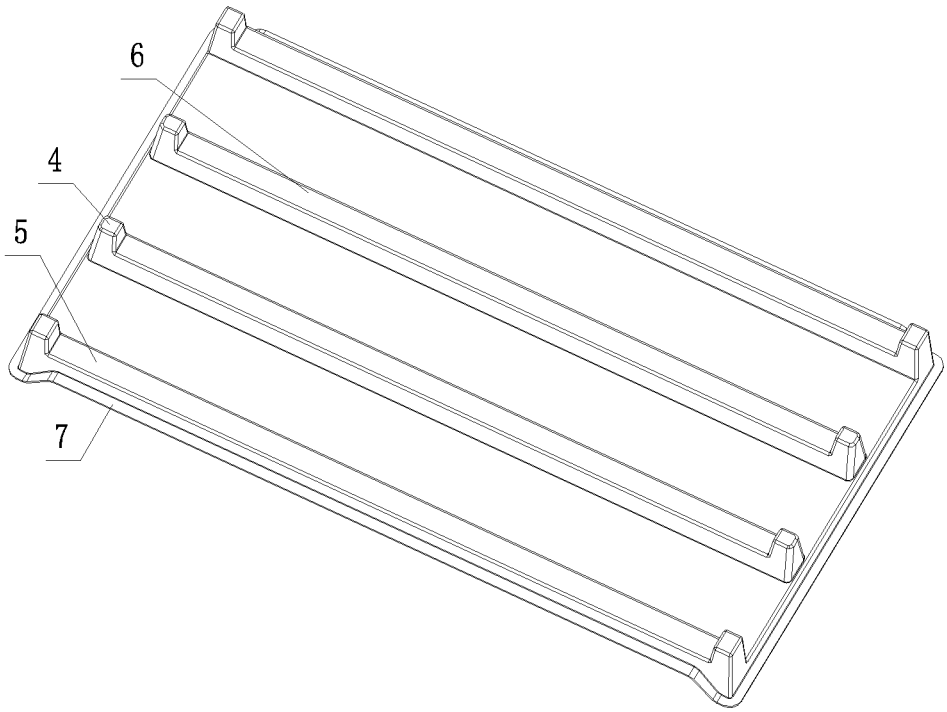
FIG. 4 is a structural diagram showing a second fin in the present disclosure.

As shown in FIG. 3 and FIG. 4, downward convex pins 4 are arranged on a lower surface of two upwards bent side edges of each fin 1, and slots 5 matched with the pins 4 are arranged in an air inlet and an air outlet in the front and rear of air paths of each fin 1. Fins 1 are arranged in a mode of vertical-horizontal alternating. The pins of the upper fin correspond to the position of the slot 5 of the lower pin, and are inserted into the same to connect the two upper and the lower adjacent fins.

A plurality of downward profiled grooves 6 are arranged in parallel on the fin 1 in a direction vertical to the air path formed by the fin 1 and an upper fin, and an air path formed with a lower fin is divided into a plurality of parallel air paths by profiled grooves 6. The profiled grooves 6 not only can form the air path to guide the air flow, but also increase the strength of the fins to avoid the deformation and play a role of reinforcing ribs. Meanwhile, a plurality of profiled grooves are added, equivalently that the contact surface for heat dissipation is increased on the same projected area, thereby increasing the heat exchange efficiency.

The downward profiled grooves 6 are arranged on the fin 1 in the air inlet and the air outlet in the front and rear of air paths formed between the fin 1 and an upper fin, and the profiled grooves 6 form the slots 5, namely, the profiled grooves 6 of the fin 1 in the air inlet are the slots 5; and downward convex pins 4 are formed as the profiled depth on both side ends of the profiled grooves 6 is larger than the profiled depth in the middle. In this way, the pins 4 can be formed only by changing the profiled depth, rather than carrying out separate profiling for the pins 4, thereby simplifying a forming process. So, the pins 4 correspond to the profiled grooves 6; however, the positions of the pins 4 are not limited to correspond to the profiled grooves 6, the pins 4 can be distributed in any location on the lower surface of two side edges bent upward, and it is the best to guarantee that each pin is located at two sides respectively, and at least one is distributed in the middle.

Four side edges of the fin 1 are bent outwards to form turn-ups 7; and turn-ups of adjoining upper and lower fins are overlapped. The turn-ups 7 of the slots 5 are overlapped on turn-ups which are bent upwards first before bent outwards on the lower fin to fit closely together and form an enclosed air path, where the turn-ups of two side edges bent upwards are higher than the fin, the turn-ups of two side edges where the slots are arranged are lower than the fin, and the relatively low turn-up in the slots of the upper fin is overlapped on the relatively high turn-up at an upward bending place of the lower fin to fit closely together and form an enclosed air path, and meanwhile, play a role of limitation. The pins 4, the slots 5 and the bent turn-ups 7 are located and connected and are superposed directly in a mode of vertical-horizontal alternating, without using other connecting components; and the positioning is simple and accurate.

Thickness of the fin 1 is 0.2-0.5 mm, or 0.3 mm, thereby ensuring the strength and guaranteeing the strength of the heat exchanger.

As shown in FIG. 1 and FIG. 2, the heat exchanger is formed by superposing a plurality of groups of fins, including a first fin 11 and a second fin 12, where two long side edges of the first fin 11 are bent upwards to form a ventilated air path in coordination with its upper fin, and two short side edges of the second fin 12 are bent upwards to form a ventilated air path in coordination with its upper fin; if the first fin 11 and second fin 12 are square and identical in a structure, the first fin 11 and the second fin 12 are alternately arranged to form the horizontal and the vertical air paths independent from each other at certain intervals. The turn-ups that extend outwards are arrange around the fins, where the turn-ups of two side edges bent upwards are higher than the fin, the turn-ups of two side edges where the slots are arranged are lower than the fin, and the relatively low turn-up in the slots of the upper fin is overlapped on the relatively high turn-up at an upward bending place of the lower fin to fit closely together and form an enclosed air path.

Figure 5:
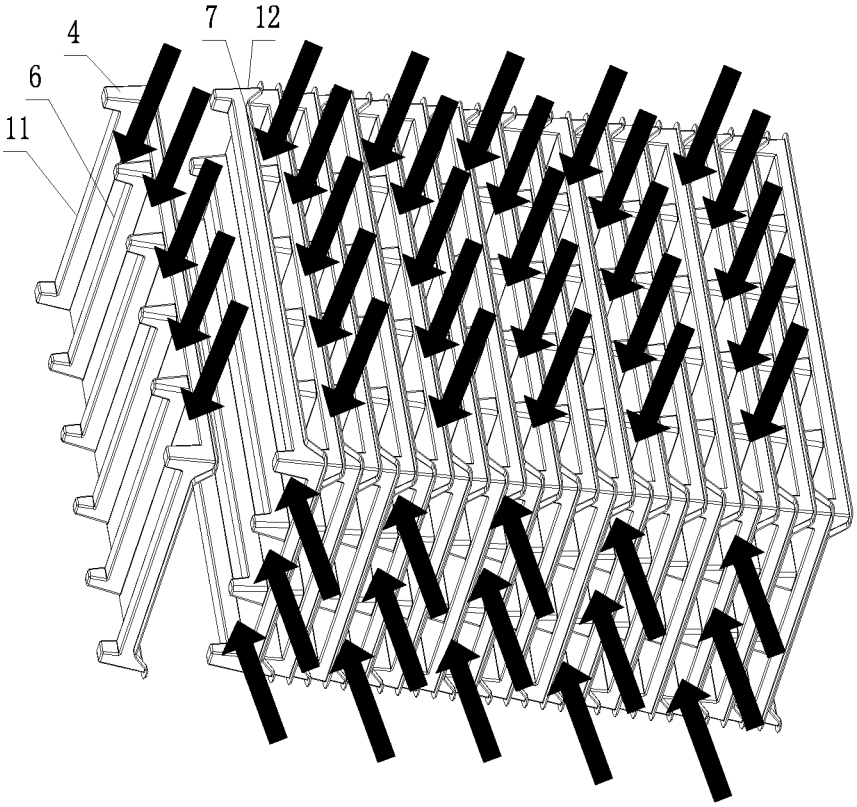
FIG. 5 is a use schematic diagram showing a superposed heat exchanger in the present disclosure.

As shown in FIG. 5, when use, one air path is in a horizontal direction and the other is in a vertical direction. The relatively low temperature air flow passes through the horizontal air path, and the relatively high temperature air flow passes through the vertical air path. Heat exchange is presented when the air flow passes through the air path, where water vapor in the relatively high temperature air flow in the vertical air path condenses when cooling, and condensate flows out of the heat exchanger downwards along the side wall of the air path. When the heat exchange is used in a clothes dryer or a washer dryer, the vertical air path is communicated with a hot humid air outlet of the clothes dryer or the washer dryer via a fan, the horizontal air path is communicated with outside air via the fan, the fan sucks the outside air into the horizontal air path and sucks the hot humid air in the clothes dryer or the washer dryer into the vertical air path, and the water vapor in the hot humid air is condensed into condensate and flows out of the heat exchanger downwards along the side wall of the air path to a water collection box of the clothes dryer or the washer dryer.

Figure 6:
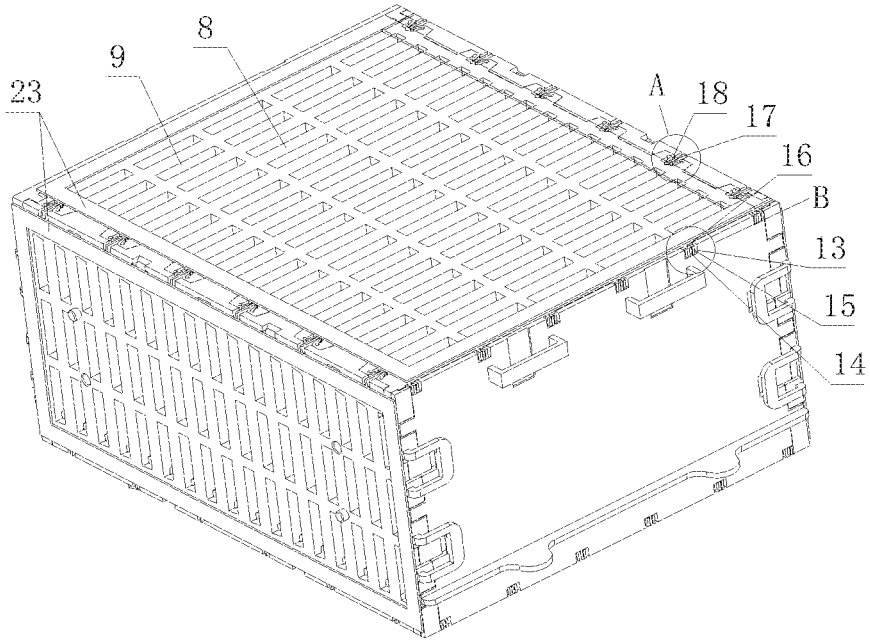
FIG. 6 is a structural diagram showing a heat exchanger with a frame in the present disclosure.
Figure 9:
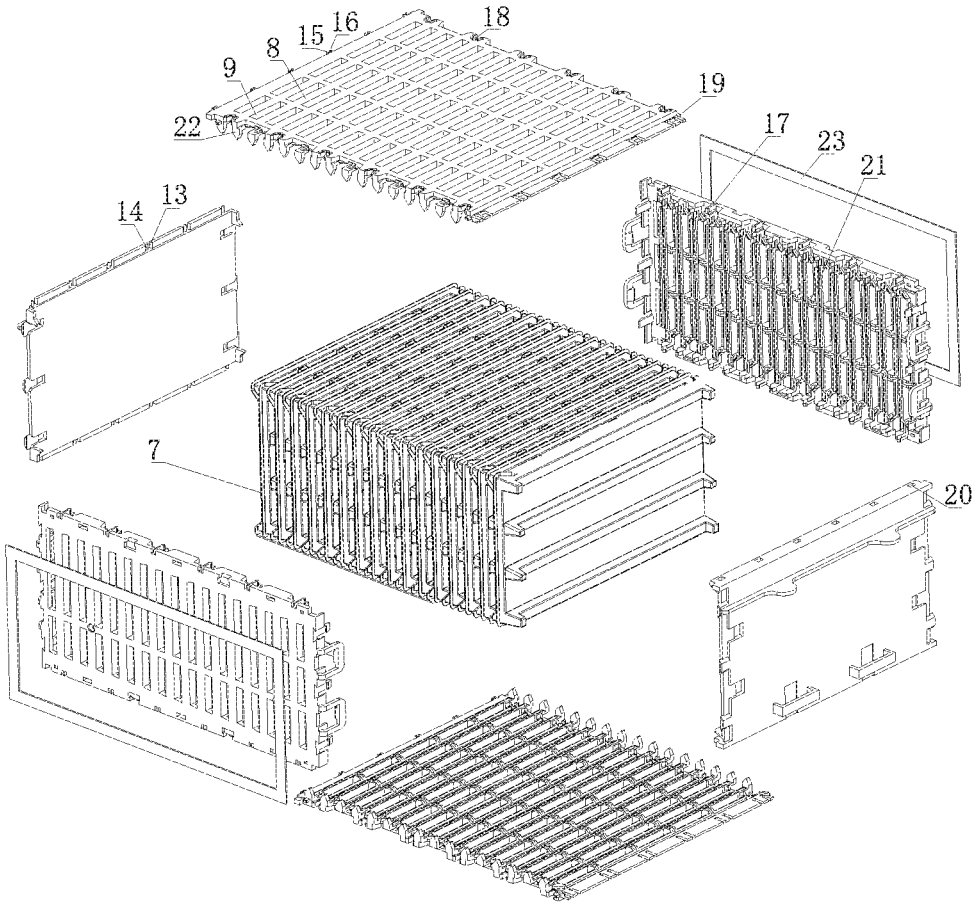
FIG. 9 is an exploded diagram showing a heat exchanger with a frame in the present disclosure.
Figure 10:
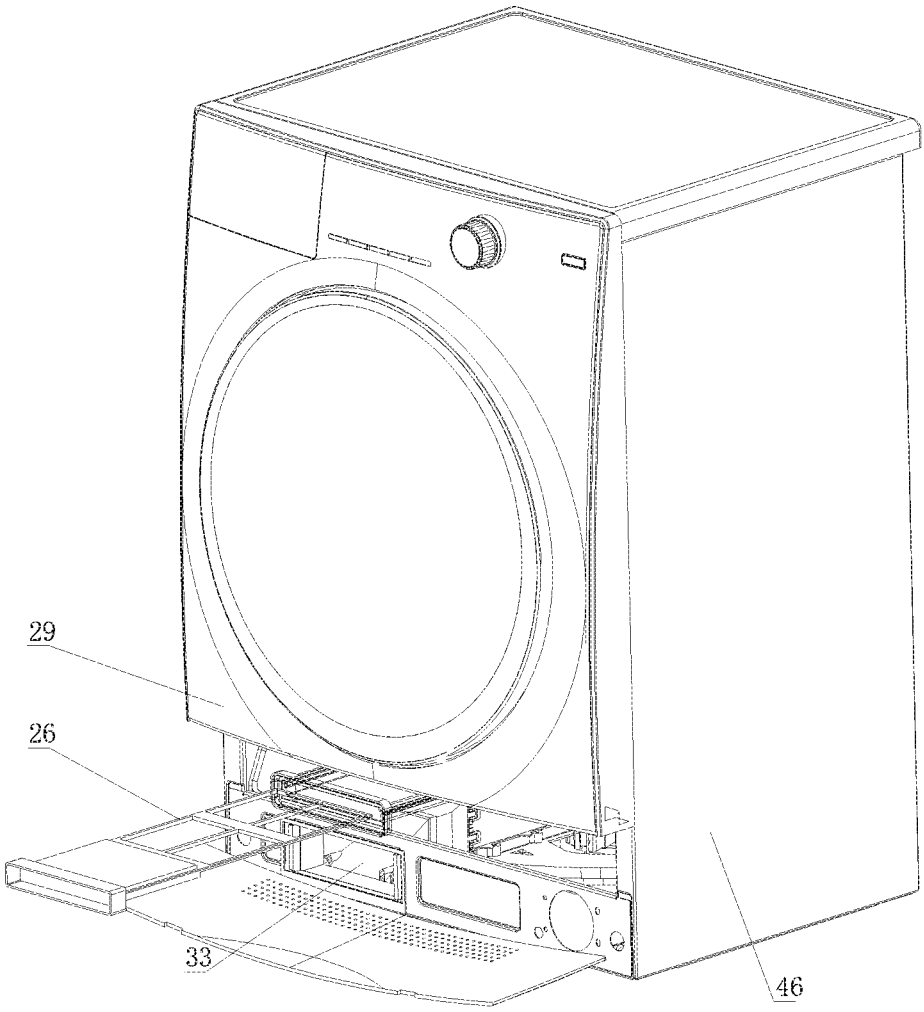
FIG. 10 is an exterior structural diagram showing a clothes dryer or washer dryer in the present disclosure.
Figure 11:
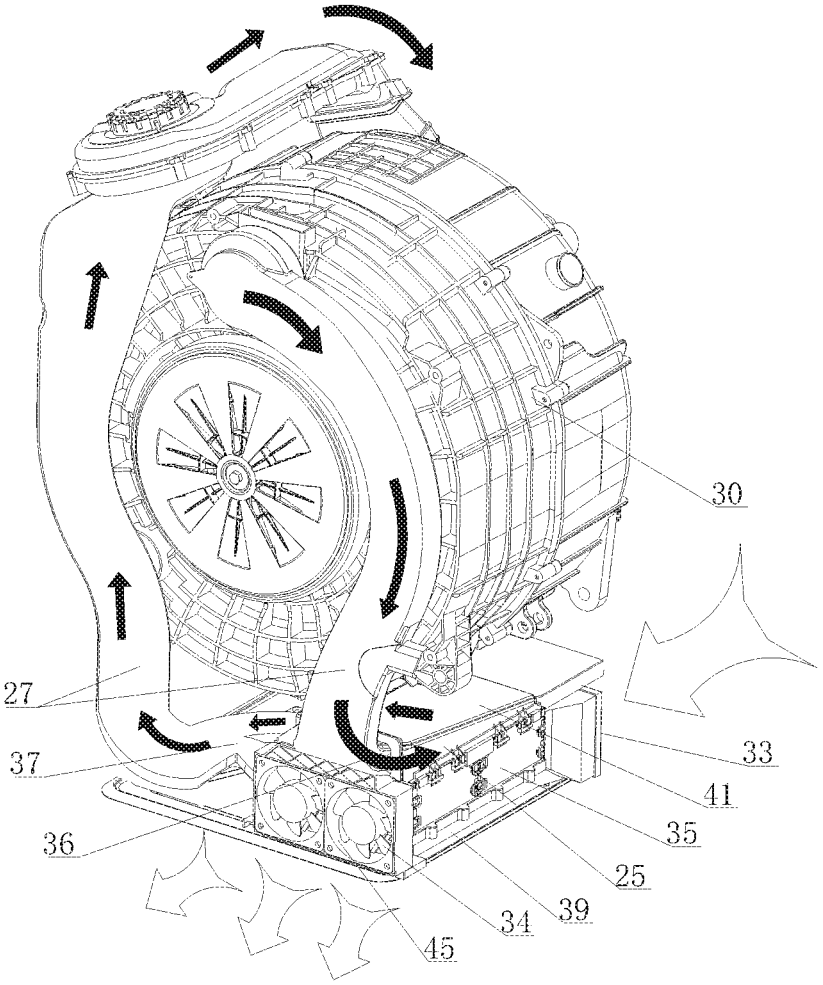
FIG. 11 is an interior structural diagram showing a clothes dryer or washer dryer in the present disclosure.

As shown in FIG. 6 and FIG. 9, in order to enhance the strength of the heat exchanger, improve the operational reliability of the heat exchanger, prolong the service life, reduce the failure maintenance rate and the maintenance cost of the machine, a frame is arranged outside the heat exchanger in the present disclosure and frame plates 8 are arranged on six sides of the heat exchanger, i.e. an upper side, a lower side, a left side, a right side, a front side and a rear side. The frame is in an enclosure structure formed by connecting the frame plates 8 arranged on the sides of the heat exchanger.

Two opposite frame plates 8 on the frame are provided with through holes 9 matched with the interior air path of the heat exchanger, and the other group of opposite frame plates 8 are flat plates. On one hand, the frame forms a sealed chamber by the flat plates; and, on the other hand, the flat plates are connected with other two groups of opposite frame plates, thereby further strengthening the connecting effect, and avoiding the deformation of two groups of opposite frame plates.

Figure 7:
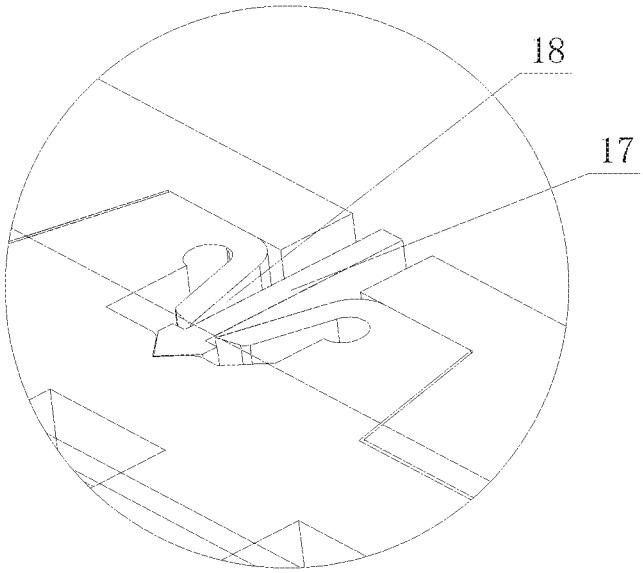
FIG. 7 is an enlarged view of A position in FIG. 6.
Figure 8:
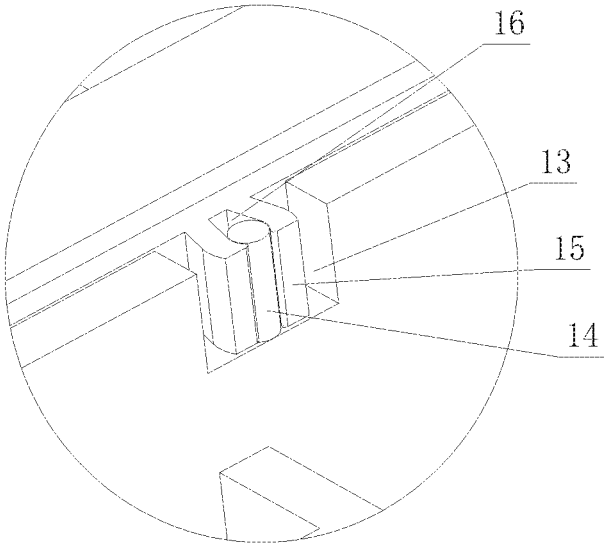
FIG. 8 is an enlarged view of B position in FIG. 6.

As shown in FIG. 6, FIG. 7 and FIG. 8, connecting parts are arranged at a junction of each frame plate of the frame, and the adjacent frame plates are connected through the connecting parts; the connecting parts may be in a buckle structure, therefore, the structure is simple, and the installation is convenient.

Further, the buckle structure means that, a notch 13 is formed at the edge of one of the frame plates 8, a clamping column 14 in a cylinder shape is arranged in the notch 13, a clamping bulge 15 is arranged at the edge of the frame plate 8 connected with the clamping column 14, a hole 16 is formed in the clamping bulge 15, the clamping bulge 15 is inserted into the notch 13, the two frame plates 8 are positioned, the clamping column 14 in the notch 13 is inserted into the hole 16 in the clamping bulge 15, thereby realizing the connection (see FIG. 8).

Or, the buckle structure means that, a "T"-shaped clamping tongue 17 is arranged at the edge of one of the frame plates 8, a clamping port 18 in a shape of Chinese character "八" is arranged at the edge of frame plate connected with the clamping tongue 17, the "T"-shaped clamping tongue 17 is spliced into the clamping port 18 in a shape of Chinese character "八" and inserted from the relatively wide end of the clamping port 18 in a shape of Chinese character "八", the clamping port 18 in a shape of Chinese character "八" has a certain deformation quantity, the relatively narrow end of the clamping port 18 in a shape of Chinese character "八" is broadened by the clamping tongue 17 forcibly, and the clamping port 18 gets back into shape after the relatively wide head of the clamping tongue 17 is inserted into the clamping port 18, and the clamping tongue 17 cannot be drawn out in a reverse direction, thus realizing fixed connection (see FIG. 7).

Or again, the buckle structure means that, a protruded buckle 19 is arranged on the side surface of one of the frame plates 8, an edgefold vertical to the frame plate is arranged at the edge of the frame plate 8 connected with the buckle 19, a recessed clamping groove 20 is arrange at a position that the side surface of the edgefold corresponds to the buckle, and the buckle is connected with the clamping groove in a clamping manner.

A plurality of buckle structures above can be either used independently or on the same framer. Any two or three buckle structures can be used in a combined way.

A plurality of parallel grooves 21 are formed in the internal surface of two groups of frame plates with the through holes 9, and correspond to the turn-ups 7 closely fit around the heat exchange. The closely fit turn-ups 7 are spliced into the grooves 21 on the internal surface of the corresponding plate frame, and the turn-up of each fin 1 is inserted into each groove 21 in the frame after being closely combined with the turn-up of the upper or the lower fin, thereby not only fixing the fin, but also playing a role of increasing the fin strength and improving the operational reliability.

Specifically: the heat exchanger includes a plurality of fins 1 that are superposed up. Two opposite side edges of each fin are bent upwards to form a ventilated air path in coordination with an upper fin, and adjacent fins are arranged in a mode of vertical-horizontal alternating so as to form horizontal air paths and vertical air paths independent from each other at certain intervals. Through holes formed in two groups of opposite frame plates correspond to an inlet and an outlet of the horizontal and the vertical air paths respectively. Four side edges of each fin are bent outwards to form turn-ups 7, and the turn-ups of the upper and lower adjacent fins are overlapped. The turn-ups in the slot are overlapped on the turn-ups 7 which are bent upwards and outwards on the lower fin, and fit closely. The closely fit turn-ups 7 correspond to grooves 21 in the internal surface of the frame plate, and are spliced in the groove 21 on the internal surface of the corresponding frame plate 8.

A plurality of sheet-shaped bulges 22 vertical to the frame plate 8 are arranged on each edge of two groups of frame plates with the through holes 9, and the shape of the sheet-shaped bulges 22 is identical with that of a space between the two adjacent turn-ups on the pins. The sheet-shaped bulges 22 are spliced into the corresponding space between the two adjacent turn-ups on the pins respectively.

Specifically: the pins 4 protruded downwards are arranged on the lower surface of two side edges of the fins 1 bent upwards, and the slots 5 recessed downwards are formed on the upper surface of other two side edges thereof. The pins 4 of the fin 1 are inserted into slots 5 on the lower fin thereof to connect two upper and lower adjacent fins; at least one pin 4 may be arranged at four corners of the fin respectively, the turn-up 7 bent downwards and outwards is located at one side of the pin, and the turn-up 7 bent upwards and outwards is located at the other side thereof, thereby realizing the smooth transition at the pins 4. The shape of the sheet-shaped bulges 22 is identical with that of the space between the two adjacent turn-ups on the pins. The sheet-shaped bulges 22 are spliced into the corresponding space between the two adjacent turn-ups on the pins respectively.

In the heat exchanger with a frame in the present disclosure, heat exchangers are connected with each other through the pins 4 and the slots 5, and the closely fit turn-ups 7 of every two adjacent fins are inserted into the grooves 21 of the frame plate, thereby fixing the heat exchanger, and simultaneously improving the strength; moreover, the sheet-shaped bulges on the frame plate are inserted into the space between transition turn-ups on the pins, thereby further realizing fixation. Each structure is limited, positioned, fitted and supported by each other.

A seal baffle 23 is arranged outside the frame. A seal baffle 23 may be arranged on the edge of the frame plate 8 with through holes matched with the internal air path of the heat exchanger, thereby enhancing the air tightness of the frame and strengthening the appearance integrity of the whole heat exchanger.

Figure 12:
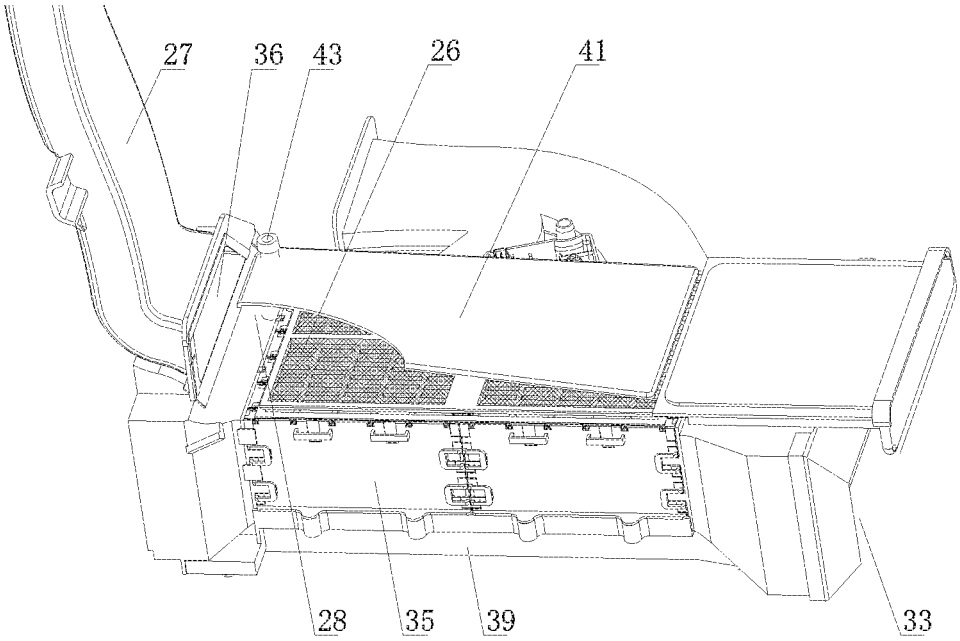
FIG. 12 is a structural diagram showing an air condensing structure in the present disclosure.
Figure 13:
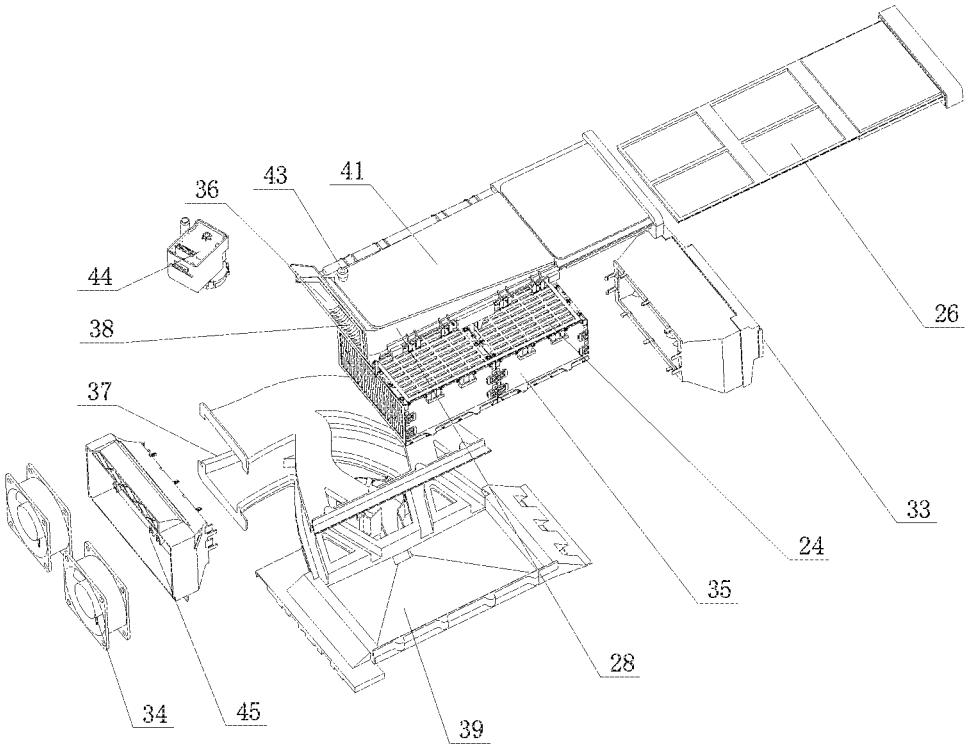
FIG. 13 is an exploded diagram showing an air condensing structure in the present disclosure.

As shown in FIG. 12 and FIG. 13, in another embodiment of the present disclosure, a plurality of heat exchangers can be connected for use, thereby improving the contact area and time of cold and hot air flow, and enhancing the heat exchange efficiency.

The frame in the present disclosure plays a role of positioning connection and reinforcement, thereby enhancing the reliable operation of components, fixing the fins of the heat exchanger, and realizing mutual assembly and mutual positioning; and moreover, the structure is simple, and the installation is convenient.

As shown in FIG. 10, FIG. 11, FIG. 12 and FIG. 13, the heat exchanger with the frame in the present disclosure is applied in the clothes dryer or the washer dryer, wherein the clothes dryer or washer dryer at least includes a drying system. The drying system includes a heating structure and a condensing structure, where the condensing structure is arranged at the lower part of a drum 30 of the clothes dryer or the washer dryer, includes an air inlet 36 and an air outlet 37 of hot air, and further includes an inlet port 33 and an outlet port 45 of cold air. A heat exchanger 35 is arranged inside the condensing structure, and includes fins arranged in a mode of vertical-horizontal alternating. The heat exchanger 35 includes two groups of air paths crossed to each other, one of which is connected with the hot air path 31 and the other is connected with cold air path 32. A frame in an enclosure structure is arranged outside the heat exchanger 35.

A front panel 29 or a side plate 46 of the clothes dryer or the washer dryer is arranged vertically in a length direction of the condensing structure. The front panel 29 of the clothes dryer or the washer dryer may be arranged vertically in the length direction of the condensing structure.

The air inlet 36 of the condensing structure is formed at the top and the air outlet thereof 37 is located at the bottom. In this way, when hot air passes through the condensing structure, water vapor in the hot air is condensed into condensate by meeting cold, and can flow downward to a condensate water collection device along an inner wall of the condensing structure under the action of a gravity. The air inlet 36 and the air outlet 37 are communicated with the drum 30 through an air duct 27 of clothes dryer; and a fan is arranged on either the inlet port 33 or the outlet port 45, and the other one is connected to the atmosphere.

The inlet port 33 is installed in the front part of the washer dryer, and the outlet port 45 is arranged in the rear part thereof; the fan 34 is arranged at the outlet port 45, so that air is sucked in from the front part under the action of the fan 34 and discharged from the rear part after exchanging heat with the hot air in the heat exchanger 35. The front part of the clothes dryer or the washer dryer is required to be open to take and place clothes, and generally, no obstacle exists. The inlet port 33 is formed in the front part of the clothes dryer or the washer dryer to ensure the smooth air suction, and the outlet port 45 is installed in the rear part of the clothes dryer or the washer dryer to discharge air from behind, without disturbing front users.

In order to increase the heat exchange efficiency of the condensing structure, the superposed heat exchanger is adopted in the present disclosure, made of plastics and is characterized by simple molding, controllable thickness, and very thin shape; and the number of fins can be increased within an effective space so as to increase the heat dissipation area, and increase the heat exchange efficiency; and moreover, the positioning is simple and accurate.

In a clothes dryer or a washer dryer, the condensing structure is used for condensing hot humid air on a circulating air path of the clothes dryer or the washer dryer. Line chips may be produced when moving and drying and are easily accumulated in long-time operation due to the multiple layers of fins in the heat exchanger 35. To prevent the line chips brought out from the clothes dryer or the washer dryer through the hot air path 31 from blocking the air path of the heat exchanger 35, a filtering structure 26 is arranged in the hot air inlet 24 of the heat exchanger 35 to effectively filter such impurities as the line chips and prevent the same from entering the heat exchanger to cause the unsmooth flow of air paths or block the same. The filtering structure 26 can be arranged between the air inlet 36 of the condensing structure and the hot air inlet 24 of the heat exchanger 35 in a push-and-pull manner.

As shown in FIG. 12 and FIG. 13, an upper cover plate 25 is arranged at the hot air inlet 24 of the heat exchanger 35, and provided with a slanting top surface. The upper cover plate 25 forms a chamber 28; the air inlet 36 is formed in the chamber 28 at one end where the upper cover plate is inclined highly and far away from the heat exchanger; the end where the upper cover plate is inclined highly and far away from the heat exchanger is bent upwards; and the air inlet 36 of the condensing structure is formed at the other side relative to the end. The filtering structure is arranged in the chamber 28, the air inlet 36 is formed at one side of the filtering structure, and the hot air inlet 24 of the heat exchanger is formed at the other side thereof. In this way, the line chips in the hot air are stopped by the filtering structure after the hot air enters the air inlet 36 and after entering the hot air inlet 24, thereby avoiding the line chips from entering the heat exchanger. The filtering structure shall be cleaned regularly.

The filtering structure 26 is connected with the side wall of the chamber 28 in a sliding manner, and one end of the filtering structure stretches out the chamber 28. The length of the filtering structure 26 in a push-and-pull direction is larger than the length of the heat exchanger 35 in the push-and-pull direction of the filtering structure. When one end of the filtering structure 26 is located in the innermost part of the chamber 28, the other end thereof is located outside the chamber. The filtering structure 26 can be drawn out for cleaning. When one end of the filtering structure 26 is located in the innermost part of the chamber 28, one end of the filtering structure located outside the chamber is tightly connected with an opening of the chamber 28 that the filtering structure passes through, thereby ensuring that the internal hot air is not leaked during normal use.

Chutes/sliding blocks are arranged on two side edges of the filtering structure 26, and sliding blocks/chutes are arranged on the side wall of the corresponding chamber, where the chutes/sliding blocks are matched with the sliding blocks/chutes, thereby forming a sliding connection and facilitating the pull and push of the filtering structure.

The filtering structure 26 and the heat exchanger 35 are installed at the bottom of the clothes dryer or the washer dryer, and arranged vertical to the front panel 29 of the clothes dryer or the washer dryer. The filtering structure 26 can be pushed and pulled along a direction of the front panel 29 vertical to the clothes dryer or the washer dryer. During normal condensation, one end of the filtering structure 26 is located in the innermost part of the chamber 28 and the other end thereof is located outside the chamber 28. When cleaning, the filtering structure is pulled out by opening a bottom panel for cleaning.

The filtering structure is a filter screen, where the area of the filter screen corresponds to that of the air inlet of the heat exchanger. Frames are arranged around the filter screen, the slots are arranged on the internal side wall of the upper cover plate, and the frames are spliced in the slots of the internal side wall of the upper cover plat, thereby realizing the sliding connection.

The line chips are produced when drying; the numerous layers of fins of the heat exchanger 35 are arranged; the clearance between adjacent layers is narrow; the line chips are easily accumulated in long-time operation; and after the installation of a filtering structure, the line chips are easily accumulated at the filtering structure for the long-time operation; therefore, to facilitate the cleaning of the line chips inside the heat exchanger, a washing structure is arranged in the hot air inlet of the heat exchanger 35, or, in order to facilitate the cleaning of the line chips filtered by the filtering structure, a washing structure is arranged between the air inlet 36 of the condensing structure and the hot air inlet 24 of the heat exchanger, and located above the filtering structure.

Figure 14:
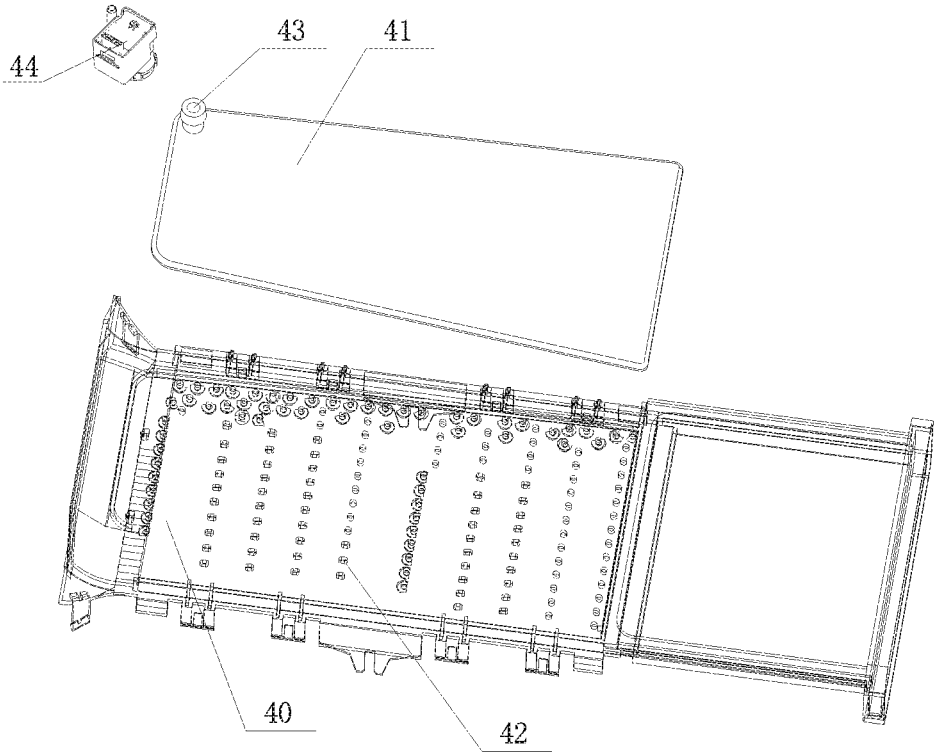
FIG. 14 is a structural diagram showing a flushing structure in the present disclosure.

As shown in FIG. 13 and FIG. 14, the washing structure includes a spray layer 40 and a seal cover 41, where a cavity is formed by the spray layer 40 and the seal cover 41. A plurality of spray holes 42 are formed in the spray layer 40, and a water inlet 43 is formed in the seal cover 41, connected with a water pump 44, and communicated with tap water or other water sources through the water pump 44. At the end of drying operation or during the operation or during routinely washing of the heat exchanger, certain hydraulic pressure can be formed because the clearance between the spray layer 40 and the seal cover 41 is narrow, and a water column can be injected from each spray hole by virtue of hydraulic pressure to wash each air path of the heat exchanger.

An upper cover plate 25 is arranged at the hot air inlet 24 of the heat exchanger, and provided with a slanting top surface. A chamber 28 is formed by the upper cover plate 25 and the heat exchanger; the air inlet is formed in the chamber 28 at one end where the upper cover plate is inclined highly and is far away from the heat exchanger; the end where the upper cover plate is inclined highly and far away from the heat exchanger is bent upwards; and the air inlet 36 of the condensing structure is formed at the other side relative to the same. The spray layer 40 is a slanting top surface of the upper cover plate 25, and a plurality of spray holes 42 are arranged on the slanting top surface and evenly distributed on the upper cover plate 25.

The spray hole 42 has an aperture range of 2 mm to 6 mm at an interval of 5 mm to 10 mm, thereby bringing convenience to washing all air paths of the heat exchanger.

The seal cover 41 is installed on the top of the upper cover plate 25 and connected with the same tightly, and a relatively small clearance is formed between the spray layer and the seal cover, which is 4 mm to 8 mm. The clearance can ensure that entering water can form certain hydraulic pressure inside to inject the water column through each spray hole to wash the air paths.

The washing structure is located at the top of the filtering structure 26 to wash the filtering structure, thereby saving the effort of opening the bottom panel and drawing out the filtering structure 26 for cleaning every time.

The air inlet 36 of the condensing structure is an integral air inlet, and the hot air inlets 24 of the heat exchanger are a plurality of air inlets; and the sectional area of the air inlet of the condensing structure is smaller than that of the hot air inlets of the heat exchanger. The air outlet 37 of the condensing structure is an integral air outlet, and the hot air outlets of the heat exchanger are a plurality of air inlets; and the sectional area of the air outlet 37 of the condensing structure is smaller than that of the hot air outlets of the heat exchanger. An air intake and uniform is arranged between the air inlet 36 of the condensing structure and the hot air inlets 24 of the heat exchanger to realize the uniform transition of the same, and an air outtake uniform structure is arranged between the air outlet of the condensing structure and the hot air outlets of the heat exchanger to realize the uniform transition of the same.

Figure 15:
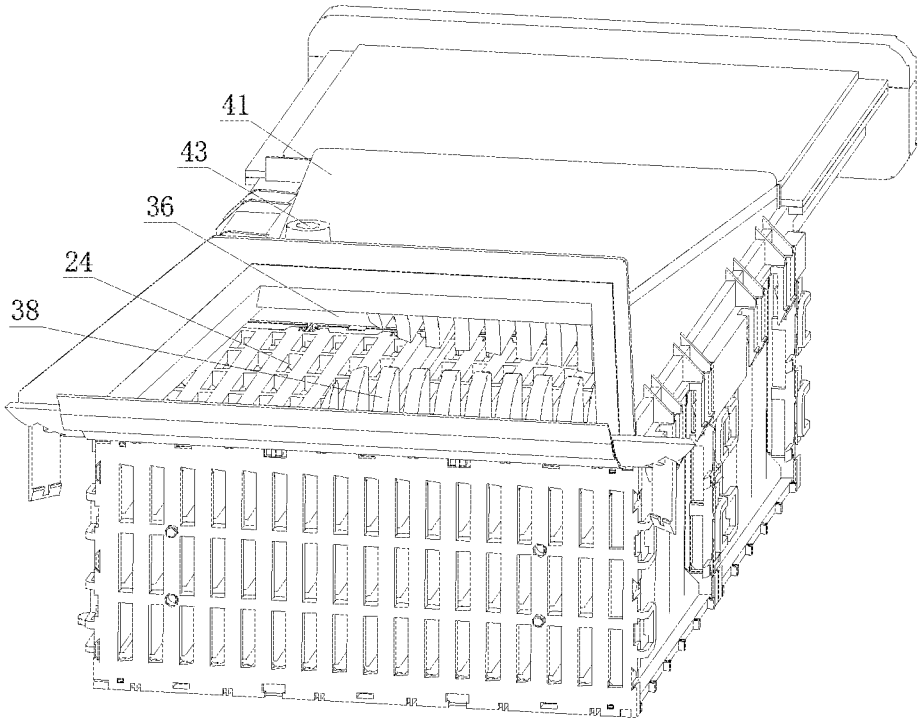
FIG. 15 is a structural diagram showing an air uniform structure in the present disclosure.
Figure 16:
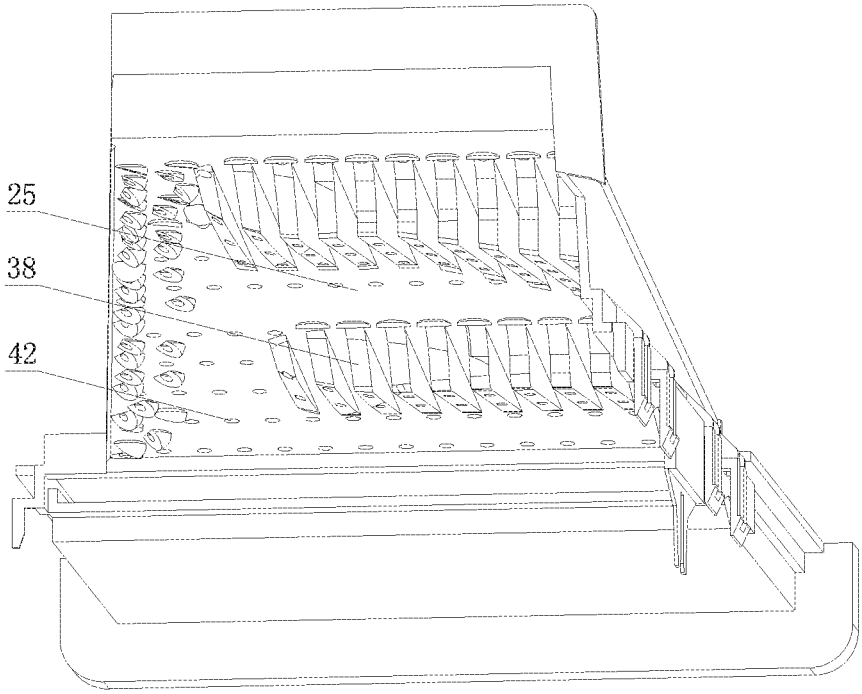
FIG. 16 is a structural diagram showing an upper cover plate in the present disclosure.

As shown in FIG. 15 and FIG. 16, the air intake and uniform is as follows: an upper cover plate 25 is arranged at the hot air inlet 24 of the heat exchanger and provided with a slanting top surface. A chamber is formed by the upper cover plate 25 and the heat exchanger; the air inlet is formed in the chamber at one end where the upper cover plate is inclined highly and is far away from the heat exchanger; a plurality of parallel ribbed slabs are arranged on the internal surface of the air inlet; and the air inlet 36 is separated into a plurality of air paths by the ribbed slabs. In this way, under the guidance of the air paths formed by the ribbed slabs 38, hot air uniformly enters each hot air inlet 24 of the heat exchanger.

The ribbed slabs 38 are arranged along the hot air inlet 24 of the heat exchanger, and the interval of two adjacent ribbed slabs 38 corresponds to the hot air inlet 24 of the heat exchanger 35. One end where the upper cover plate 25 is inclined highly and is far away from the heat exchanger is bent upwards to form an air path with the other side surface corresponding to the same. A plurality of parallel ribbed slabs 38 vertical to the internal surface are arranged on the two opposite internal surfaces of the air inlet uniformly, and are vertically arranged.

The plurality of parallel ribbed slabs 38 are arranged on the internal surface of a slanting top surface of the upper cover plate 25; the upper part of the ribbed slabs 38 is connected with the slanting top surface; and the lower part of the ribbed slabs 38 is hung in the air. The height of the ribbed slabs 38 is corresponding to an angle of inclination of the slanting top surface and is gradually decreased downwards inside from the air inlet. A plane formed by the lower part of the ribbed slabs 38 is parallel to an upper surface of the heat exchanger.

The upper cover plate 25 and the ribbed slabs 38 are arranged in an integrated manner, for example an integrated injection molding.

As shown in FIG. 13, the air outtake uniform structure is as follows: a lower cover plate 39 is arranged at the condensed hot air outlet of the heat exchanger, and a plurality of air outlets are formed at one side of the lower cover plate 39, communicated to a general air outlet in a shape of Chinese character "众", and connected to the air duct 27 of the clothes dryer or the washer dryer in triangle arrangement. In this way, the condensed hot air from the heat exchanger first passes through the plurality of air outlets and then is gathered together into the air duct of the clothes dryer or the washer dryer. The upper cover plate 25 and the lower cover plate 39 are connected with the heat exchanger in a clamping manner, for example connected with two sheet-shaped frame plates, and connected tightly.

The above only describes embodiments of the present disclosure. It should be noted that, for those ordinary skilled in the art, several transformations and improvements can be made under the premise of not departing from the principle of the present disclosure, which shall also be considered as the protection scope of the present disclosure.

What is claimed is:

1. A superposed heat exchanger, comprising a plurality of fins superposed up; two opposite side edges of each fin are bent upwards to form a ventilating air path in coordination with an upper fin, and adjacent fins are arranged in a mode of vertical-horizontal alternating so as to form horizontal air paths and vertical air paths independent from each other;

wherein downward convex pins are arranged on lower surfaces of two upwards bent side edges of the fin, and downward concave slots are arranged in upper surfaces of other two side edges; and pins of the fins are inserted into slots on lower fins so as to connect an upper and a lower adjacent fins.

2. The superposed heat exchanger according to claim 1, wherein a plurality of downward profiled grooves are provided in parallel on the fin in a direction vertical to the air path formed by the fin and an upper fin, and an air path formed with a lower fin is divided into a plurality of parallel air paths by the profiled grooves.

3. The superposed heat exchanger according to claim 2, wherein downward profiled grooves are provided on the fin in an air inlet and an air outlet in the front and rear of air paths formed between the fin and an upper fin, and the profiled grooves form the slots.

4. The superposed heat exchanger according to claim 3, wherein a profiled depth on both ends of the profiled groove is larger than a profiled depth in middle of the profiled groove, so that a downward convex is formed so as to form the pin.

5. The superposed heat exchanger according to claim 1, wherein four side edges of the fin are bent outwards to form turn-ups; turn-ups of adjoining upper and lower fins are overlapped; and turn-ups at the slots are overlapped and fitted closely on turn-ups, which are bent upwards first before bent outwards, on a lower fin.

6. The superposed heat exchanger according to claim 1, wherein a plurality of upward profiled grooves are provided in parallel on the fin in a direction parallel to the air path formed by the fin and an upper fin, and an air path formed with an upper fin is divided into a plurality of parallel air paths by the profiled grooves.

7. The superposed heat exchanger according to claim 1, wherein materials of the fins are plastics.

8. The superposed heat exchanger according to claim 1, wherein thickness of the fins is 0.2-0.5 mm, or 0.3 mm.

9. The superposed heat exchanger according to claim 1, wherein a frame is arranged outside the heat exchanger, and frame plates are arranged on an upper side, a lower side, a left side, a right side, a front side and a back side of the heat exchanger; and the frame is of an enclosure structure formed by connecting the frame plates arranged on the sides of the heat exchanger.

10. The superposed heat exchanger according to claim 9, wherein through holes matched with an air path of an internal heat exchanger are formed in two groups of frame plates opposite to air paths of the heat exchanger on the frame, and another group of opposite frame plate is a flat plate; the through holes are rectangular through holes arranged horizontally and vertically; and the through holes formed in two groups of opposite frame plates correspond to an inlet and an outlet of a horizontal air path and a vertical air path respectively.

11. The superposed heat exchanger according to claim 10, wherein a connecting part is arranged on a connector of each frame plate on the frame, and adjacent frame plates are connected through connecting parts; each connecting part is of a buckle structure; two groups of frame plates with the through holes are provided with a plurality of parallel grooves on internal surfaces, and the grooves of the internal surfaces of the frame plates correspond to closely fitted turn-ups; the closely fitted turn-ups are inserted into grooves of internal surfaces of corresponding frame plates; a plurality of sheet-shaped bulges vertical to frame plates are arranged on adjacent edges of the two groups of frame plates with the through holes; a shape of the sheet-shaped bulges is identical with that of a space between corresponding adjacent turn-ups at the pins; and the sheet-shaped bulges are respectively inserted into the space between corresponding adjacent turn-ups at the pins.

12. The superposed heat exchanger according to claim 10, wherein the vertical air path is arranged vertically to correspond to a hot air inlet and a hot air outlet; the horizontal air path is arranged horizontally to correspond to a cold air inlet and a cold air outlet; an upper cover plate is arranged at the hot air inlet; the upper cover plate has a slanting top surface; the upper cover plate forms a chamber with the heat exchanger; the air inlet of an air condensing structure is formed on the chamber at one end where the upper cover plate is inclined highly and away from the heat exchanger; a lower cover plate is arranged at the hot air outlet of the heat exchanger; one side of the lower cover plate is an air outlet of the air condensing structure; and the upper and the lower cover plates are connected with flat frame plates.

13. The superposed heat exchanger according to claim 12, wherein a filter is arranged between the air inlet and the hot air inlet of the heat exchanger; the filter is arranged between the air inlet of the air condensing structure and the hot air inlet of the heat exchanger in a pushable-pullable mode; the filter is arranged in the chamber; the filter is in sliding connection with side walls of the chamber, and one end of the filter protrudes out of the chamber; when one end of the filter is located in the innermost place of the chamber, the other end of the filter is located outside the chamber and is tightly sealed with an opening of the chamber through which the filter penetrates; sliding chutes/sliding blocks are arranged on two side edges of the filter, and sliding blocks/sliding chutes are arranged on corresponding side walls of the chamber; and the sliding chutes/sliding blocks are matched with the sliding blocks/sliding chutes so as to form sliding connection.

14. The superposed heat exchanger according to claim 12, wherein a flushing structure is arranged between the air inlet and the hot air inlet of the heat exchanger; the flushing structure comprises a spray layer and a seal cover which form a cavity; a plurality of spray holes are formed in the spray layer; water inlets are formed in the seal cover; the spray layer serves as the upper cover plate arranged at the hot air inlet of the heat exchanger; the seal cover is arranged on an upper part of the upper cover plate and is in sealed connection with the upper cover plate; and a plurality of spray holes are formed in the upper cover plate.

15. The superposed heat exchanger according to claim 12, wherein an air intake uniform structure is arranged between the air inlet and the hot air inlet of the heat exchanger; a plurality of vertical ribbed slabs are arranged in the air inlet and on an inner surface of top of the upper cover plate so as to divide the air inlet into a plurality of uniform air paths, so that the air intake uniform structure is formed; an air outtake uniform structure is arranged between the air outlet of the air condensing structure and the hot air outlet of the heat exchanger; a lower cover plate is arranged at a condensed hot air outlet of the heat exchanger; a plurality of air outlets are formed on one side of the lower cover plate; and the plurality of air outlets in a shape of Chinese character "众" are communicated to a general air outlet, so that the air outtake uniform structure is formed.

16. The superposed heat exchanger according to claim 1, wherein the heat exchanger is arranged on a lower part of a clothes dryer or a washer dryer, with the air inlet located in an upper part and the air outlet located in a lower part; the air inlet and the air outlet are communicated with a drum through an air duct respectively; either the air inlet or the air outlet is provided with a fan, and the other one is opened to atmosphere.

* * * * *